US007104436B2

(12) United States Patent
Lackey et al.

(10) Patent No.: US 7,104,436 B2
(45) Date of Patent: Sep. 12, 2006

(54) MULTIPLE COMPONENT MAILBOX HAVING POSTAL AND NEWSPAPER COMPARTMENTS

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 11/047,976

(22) Filed: Feb. 1, 2005

(65) Prior Publication Data

US 2006/0169760 A1 Aug. 3, 2006

(51) Int. Cl.
*A47B 97/08* (2006.01)

(52) U.S. Cl. ..... 232/1 C; 232/17

(58) Field of Classification Search ..... 232/17, 232/45, 1 C, 24, 29, 43.1, 43.4; D99/29.32
See application file for complete search history.

(56) References Cited

U.S. PATENT DOCUMENTS

| | | | | | |
|---|---|---|---|---|---|
| 3,243,104 | A | * | 3/1966 | Fillion | 233/33 |
| D221,361 | S | * | 8/1971 | Parker | D99/29 |
| 4,146,171 | A | * | 3/1979 | Hodge | 232/1 C |
| D335,750 | S | * | 5/1993 | Berardi | D99/31 |
| 5,465,902 | A | * | 11/1995 | Hanson | 232/33 |
| 5,664,729 | A | * | 9/1997 | Ladewig | 232/39 |
| D385,680 | S | * | 10/1997 | Cacciola et al. | D99/29 |
| D488,908 | S | * | 4/2004 | Hradisky | D99/29 |
| D489,159 | S | * | 4/2004 | Hradisky | D99/29 |
| D489,160 | S | * | 4/2004 | Hradisky | D99/29 |
| D497,465 | S | * | 10/2004 | Hradisky | D99/29 |
| D499,225 | S | * | 11/2004 | Taylor et al. | D99/32 |
| D501,594 | S | * | 2/2005 | Taylor et al. | D99/29 |
| D503,504 | S | * | 3/2005 | Taylor et al. | D99/29 |
| D503,844 | S | * | 4/2005 | Taylor et al. | D99/32 |
| 2005/0184142 | A1 | * | 8/2005 | Brown | 232/17 |

* cited by examiner

*Primary Examiner*—William L. Miller
(74) *Attorney, Agent, or Firm*—Charles L. Schwab; Nexsen Pruet, LLC

(57) ABSTRACT

A plastic mailbox of modular construction includes a postal compartment and a newspaper compartment. The postal compartment includes a floor component which serves as a roof for a newspaper compartment positioned beneath the postal compartment. The postal compartment floor serves as an interconnecting member between the postal compartment and the newspaper compartment and is hidden from view by having its laterally opposite sides disposed in registering recesses formed in the side walls of the postal and newspaper compartments. A partial rear wall in the newspaper compartment serves as a stop for newspapers inserted into the open ended newspaper compartment.

5 Claims, 4 Drawing Sheets

37
38
44
52
36
29
39
43
51

37
38
29
39
23
36
71
42
41
72
40

MULTIPLE COMPONENT MAILBOX HAVING POSTAL AND NEWSPAPER COMPARTMENTS

BACKGROUND OF THE INVENTION

Applicants have filed the following United States patent applications:

Ser. No. 11/024,265 filed Dec. 28, 2004 for a Ground Mount Post;

Ser. No. 11/032,964 filed Jan. 11, 2005 for a Mailbox and Support;

Ser. No. 11/042,280 filed Jan. 25, 2005 for a Mailbox Door with Rain Intercepting Structure;

Ser. No. 11/047,977 filed Feb. 1, 2005 for a Mailbox with Signal;

Ser. No. 11/052,648 filed Feb. 7, 2005 for a Two Piece Mailbox Support, and

Ser. No. 11/052,591 filed Feb. 7, 2005 for a Reinforced Plastic Mailbox.

Mail delivered by rural mail carriers is placed in a mailbox approved by the United States Postal Service. Although newspapers could be delivered through the postal system, the preferred delivery of a newspaper is by a hired newspaper delivery person. Since only postal items can legally be placed in the government approved mailbox, newspapers delivered by the newspaper delivery person are usually placed in a separate newspaper receiving receptacle. In recent years mailboxes having separate postal and newspaper compartments have been approved for postal use by the United States Postal Service.

BRIEF DESCRIPTION OF THE INVENTION

The mailbox of this invention is made of a suitable strong plastic with a postal compartment having double wall top and lateral sides. A separate postal compartment floor is secured to the sides of the postal compartment. A newspaper compartment includes laterally opposite double wall sides extending upwardly from a floor integrally formed with the side walls and a partial rear wall extending up from the floor. The partial rear wall serves as a stop for newspapers thrown into the newspaper compartment through its open front. The tops of the side walls of the newspaper compartment are secured to the floor of the postal compartment and the bottom of the newspaper compartment is adapted for attachment to a suitable support. The postal compartment has a hinged front door and a hinged rear door and the newspaper compartment is open at its front and rear.

BRIEF DESCRIPTION OF THE DRAWINGS

One embodiment of the invention is shown in the accompanying drawings in which.

DETAILED DESCRIPTION OF THE INVENTION

Figure 1:
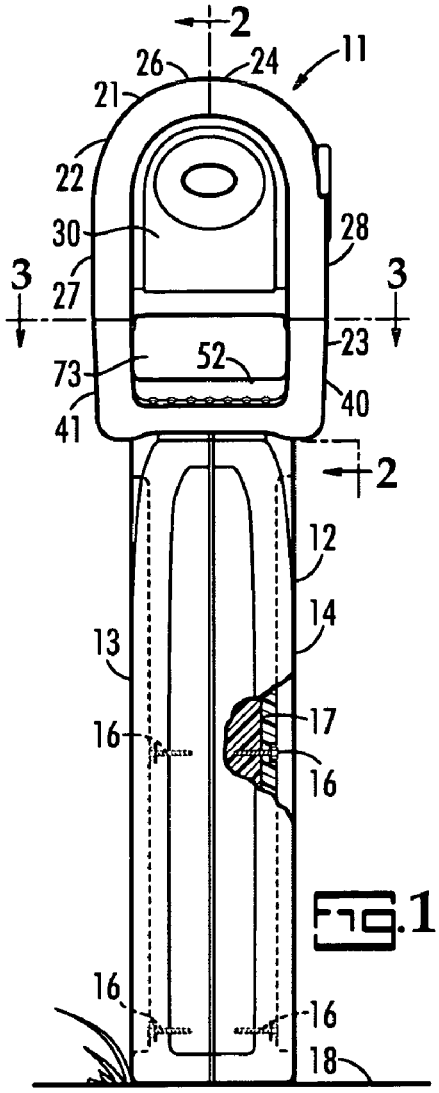
FIG. 1 is a front view of a plastic mailbox with parts broken away for illustration purposes.
Figure 3:
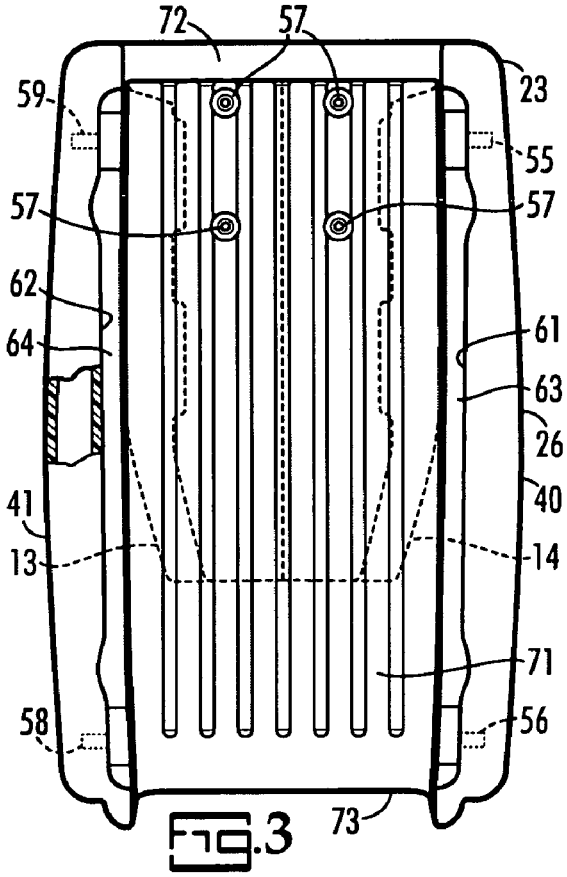
FIG. 3 is a top view of the newspaper compartment taken on line 3—3 in FIG. 1 with parts broken away for illustration purposes.
Figure 2:
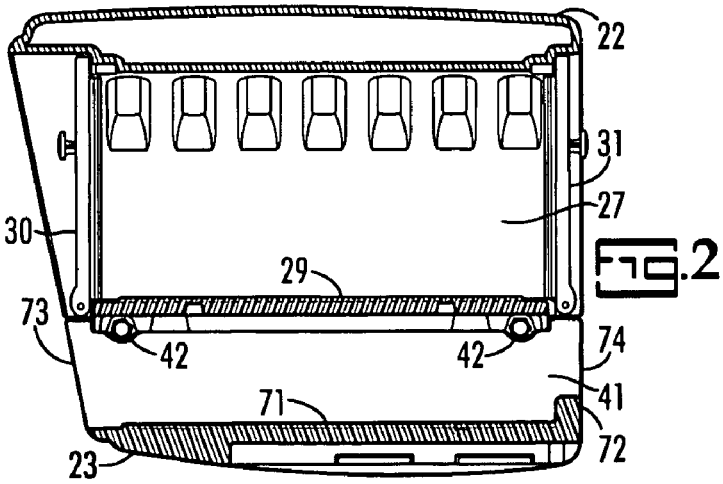
FIG. 2 is a section take on line 2—2 in FIG. 1.
Figure 4:
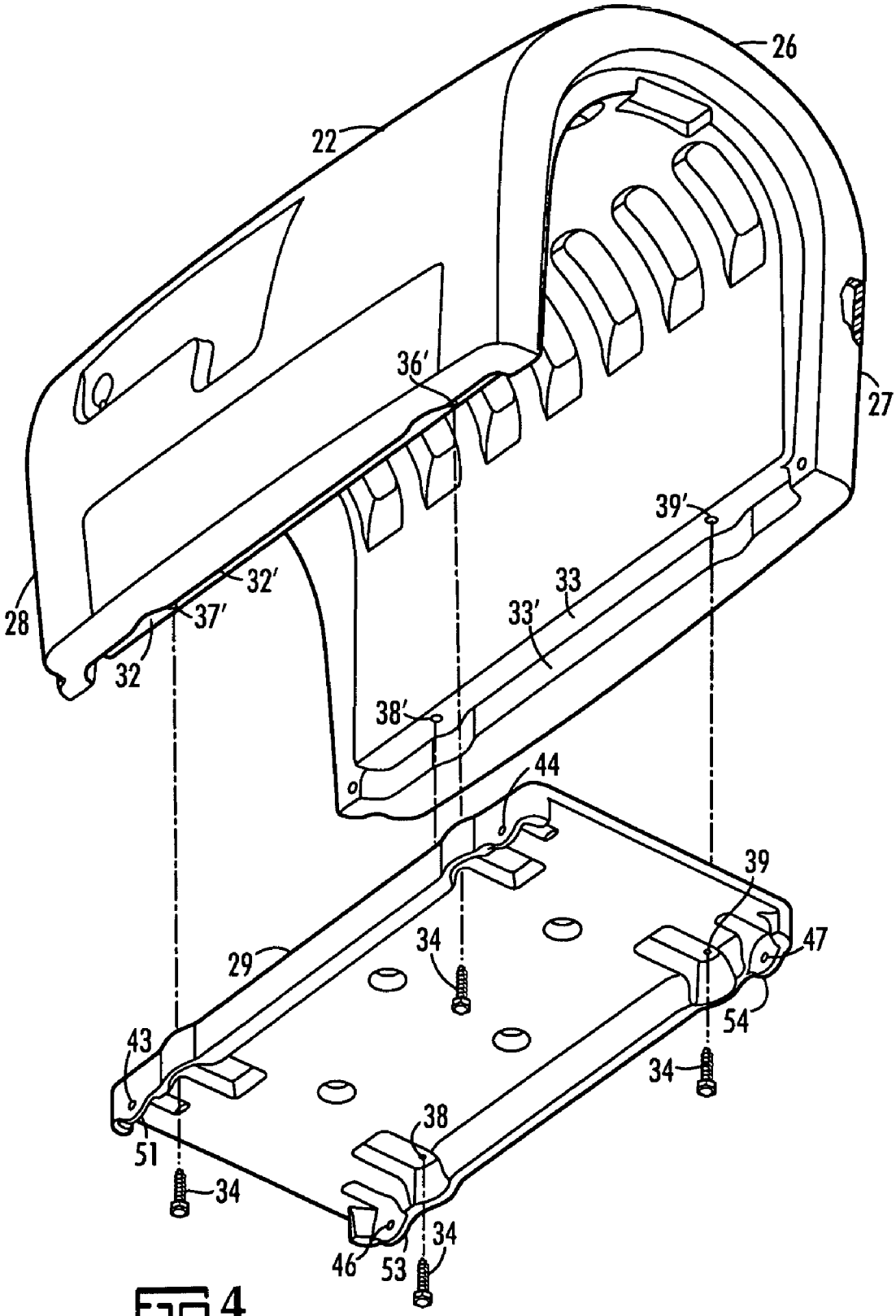
FIG. 4 is a perspective view of the postal compartment with its doors and signal removed and its floor and fasteners in an exploded position.

As illustrated in FIGS. 1, 2, 3 and 4, a plastic mailbox 11 has a support structure 12 made up of two side by side pieces 13, 14 which may be secured by screws 16 to a post 17 set in the ground 18. The mailbox 11 includes a multiple compartment housing 21 having a postal compartment 22 and a newspaper compartment 23 directly below the postal compartment 22. The postal compartment 22 includes an arched part 24, having a curved top or roof 26 and upright side walls 27, 28, and a floor 29. A front door 30 and a rear door 31 are hinged at their lower ends to the side walls 27, 28.

Figure 5:
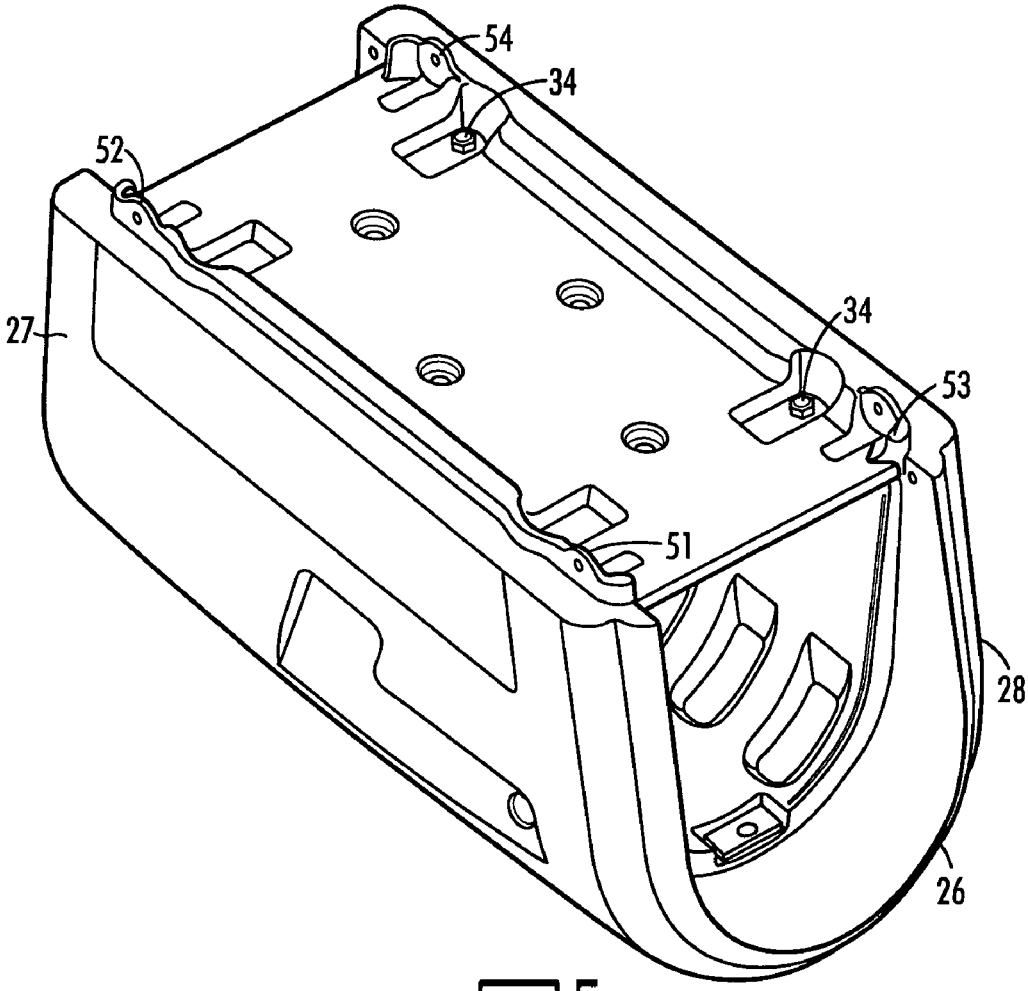
FIG. 5 is a perspective view of the postal compartment showing its floor in an installed condition.
Figure 6:
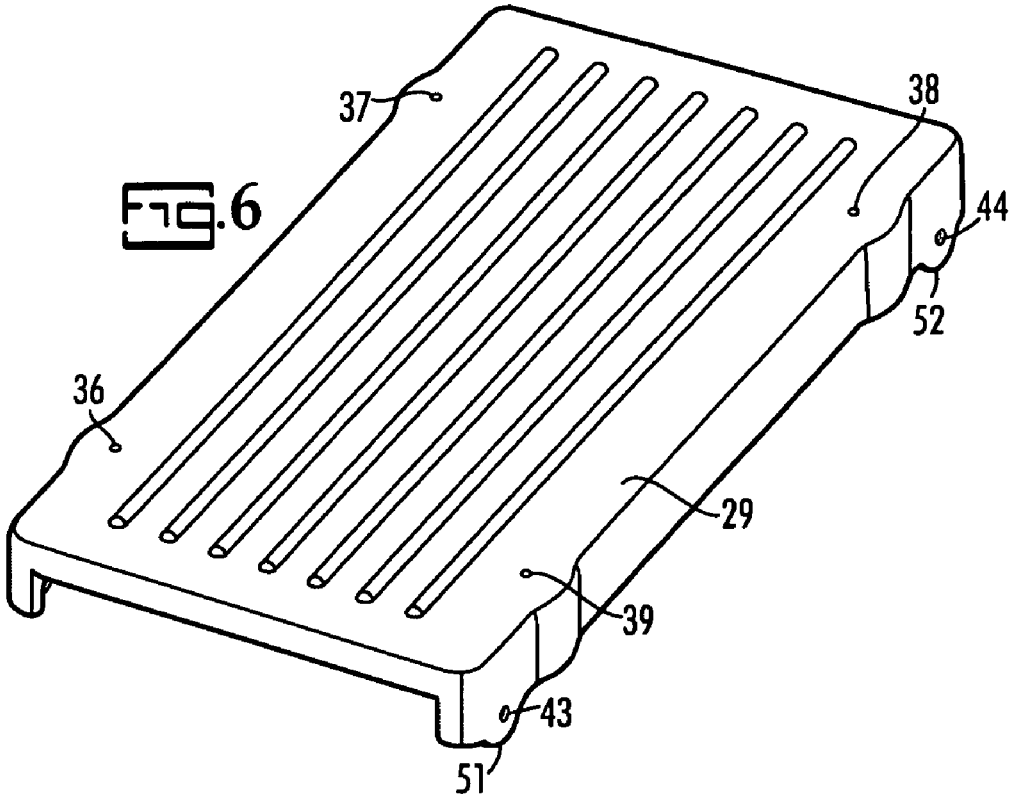
FIG. 6 is a perspective view of the postal compartment floor.
Figure 7:
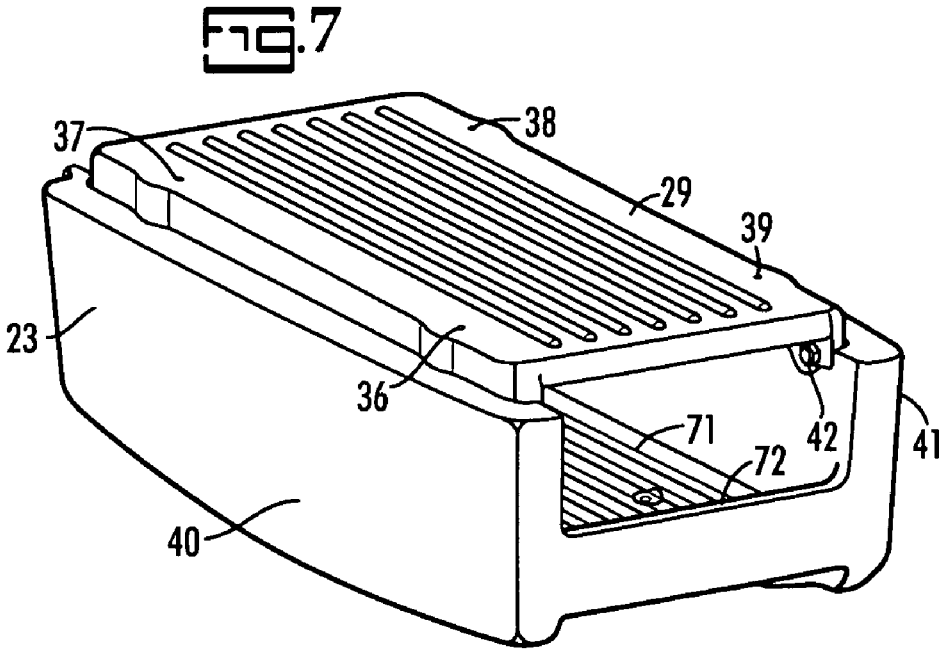
FIG. 7 is a perspective view showing the floor of the postal compartment secured to the tops of the newspaper compartment side walls.

Referring also to FIGS. 5, 6 and 7, a ribbed postal compartment floor 31 is fabricated as a separate component and is secured to shoulders 32, 33 of laterally inward facing recesses 32', 33', formed on the laterally inner corners of the lower ends of the side walls 27, 28, by vertical fasteners or screws 34. The screws 34 pass through vertical openings 36, 37, 38, 39 in the floor 29 and are in threaded engagement, respectively, with openings 36', 37', 38', 39' in the shoulders 32, 33. The postal compartment floor 31 serves as the roof of the newspaper compartment 23 and is an interconnecting member between the two compartments 22, 23. Referring to FIGS. 2 through 7, the postal compartment floor 29 is secured to laterally spaced walls 40, 41 of the newspaper compartment 23 by fasteners in the form of horizontally extending screws 42. The screws 42 extend through openings 43, 44, 46, 47 in downwardly extending flanges 51, 52, 53, 54 at the laterally opposite sides of the floor 29 and into openings 55, 56, 58, 59 in vertical sides 61, 62 of laterally confronting horizontally extending recesses 63, 64 formed in the upper ends of the side walls 40, 41.

The newspaper compartment 23 includes a ribbed horizontal floor 71 secured to the side pieces 13, 14 of the support structure 12. The newspaper box 23 also includes a low rear wall 72 extending vertically a short distance upward from its floor 71. The partial rear wall 72 serves as a stop for newspapers inserted or thrown into the newspaper compartment 23 through its front opening 73 but is low enough in height to provide an adequate rear opening 74 for manual removal of a delivered newspaper.

The roof 26 and side walls 27, 28 of the postal compartment 22 and the side walls 40, 41 of the newspaper compartment 23 are double wall constructed of a suitable plastic having high impact resistance. The floor 29 of the postal compartment 22 is hidden from external view by placement of its laterally opposite edges or ends in the laterally inward facing recesses 33', 34' of the postal compartment 22 and in the registering laterally inward facing recesses 63, 64 in the newspaper compartment 23. The illustrated construction is designed to pass the impact tests the United States Postal Services approval program. The modular construction permits compact packaging easy assembly and installation by the purchaser with readily available hand tools.

What is claimed is:

1. A multiple component mailbox comprising:

a support, a postal compartment having a front end and a rear end, said postal compartment including an arched roof, a first pair of laterally spaced upright side walls extending downwardly from said roof to lower ends, said lower ends having a first pair of laterally inward facing recesses formed therein, and a first horizontally extending floor having laterally opposite sides secured to said lower ends of said first pair of side walls, said first floor having flanges extending downwardly from its laterally opposite sides, a newspaper compartment having an open front end for insertion of a newspaper and including a second pair of laterally spaced upright side walls having upper ends secured to said first horizontally extending floor, said upper ends having a second pair of laterally inward facing horizontally extending recesses in registration with said first pair of said recesses, said flanges disposed in said registering first and second pair of recesses, a second floor secured to the lower ends of said second pair of side walls, and a partial rear wall extending upwardly from said second floor to define a partial opening in a rear end of said newspaper compartment for removal of a newspaper, said partial rear wall serving as a stop for newspapers inserted into said newspaper compartment, and means securing said second floor to said support.

2. The multiple component mailbox of claim 1 wherein said flanges are secured by fasteners to said second pair of side walls.

3. A multiple component mailbox comprising:

a postal compartment having a front end and a rear end, said postal compartment including an arched roof, a first pair of laterally spaced upright side walls extending downwardly from said roof to lower ends, said lower ends having a first pair of laterally inward facing recesses formed therein, and a first horizontally extending floor having laterally opposite sides secured to said lower ends of said first pair of side walls, said first floor having flanges extending downwardly from its laterally opposite sides, a newspaper compartment having a front end and a rear end and including a second pair of laterally spaced upright side walls having a pair of laterally inward facing horizontally extending recesses formed, respectively, in the upper ends thereof, said second pair of recesses in registration with said first pair of recesses, said flanges disposed in said registering first and second pairs of recesses recesses, and a second floor secured to the lower ends of said second pair of side walls, said newspaper compartment having openings at its front and rear ends, respectively permitting insertion and removal of a newspaper.

4. A multiple component mailbox comprising:

a support, a postal compartment having a front end and a rear end, said postal compartment including an arched roof, a first pair of laterally spaced upright side walls extending downwardly from said roof to lower ends, said lower ends having a first pair of laterally inward facing recesses formed therein, and a first horizontally extending floor having laterally opposite sides secured to said lower ends of said first pair of side walls, said first floor having flanges extending downwardly from its laterally opposite sides, a newspaper compartment having a front end and a rear end and including a second pair of laterally spaced upright side walls having upper ends secured to said first horizontally extending floor, a second pair of laterally inward facing horizontally extending recesses formed, respectively, in the upper ends of said second pair of side walls, said flanges disposed, in said registering first and second pair of recesses, and a second floor secured to the lower ends of said second pair of side walls, said newspaper compartment having openings at its front and rear ends, respectively permitting insertion and removal of a newspaper, and means securing said second floor to said support.

5. A multiple component mailbox comprising:

a support, a postal compartment having a front end and a rear end, said postal compartment including an arched roof, a first pair of laterally spaced upright side walls extending downwardly from said roof to lower ends, a laterally inward facing recess formed in said lower end of each of said first pair of side walls, and a first horizontally extending floor having laterally opposite sides secured to said lower ends of said first pair of side walls, said first floor having flanges extending downwardly from its laterally opposite sides, a newspaper compartment having a front end and a rear end and including a second pair of laterally spaced upright side walls, a laterally inward facing recess formed in said upper end of each of said second pair of side walls in registration with said recesses in said first pair of side walls, said flanges being disposed in said registering pairs of recesses and being secured to said second pair of side walls, a second floor secured to the lower ends of said second pair of side walls, said newspaper compartment having openings at its front and rear ends, respectively permitting insertion and removal of a newspaper, means securing said second floor to said support, and wherein said flanges are secured by fasteners to said second pair of side walls.

* * * * *